4-516
10/15/85 XC 4,546,504

United States Patent [19]

Vars

[11] Patent Number: 4,546,504

[45] Date of Patent: Oct. 15, 1985

[54] HEAD SUPPORT

[76] Inventor: Patricia A. Vars, 14 Russell Ave., Pawcatuck, Conn. 06379

[21] Appl. No.: 590,336

[22] Filed: Mar. 16, 1984

[51] Int. Cl.[4] ..... A54D 19/00

[52] U.S. Cl. ..... 4/515; 4/516; 4/575; 5/434

[58] Field of Search ..... 4/575, 517, 519, 523, 4/516, 520, 522, 571, 573, 578; 5/434, 435, 436

[56] References Cited

U.S. PATENT DOCUMENTS

| | | | |
|---|---|---|---|
| 492,949 | 3/1893 | Treiber | 4/575 |
| 927,531 | 7/1909 | Hedstrom | 4/517 |
| 1,203,579 | 11/1916 | Callon | 4/575 X |
| 1,817,625 | 8/1931 | Holmes | 4/523 |
| 1,868,598 | 7/1932 | Gower | 4/519 |

*Primary Examiner*—Henry K. Artis
*Attorney, Agent, or Firm*—McCormick, Paulding & Huber

[57] ABSTRACT

A head support for a beauty parlor sink includes an elongated flexible band of water resistant material having apertures proximate its opposite ends, a cord extending through said apertures, and hooks attached to the opposite ends of the cord for engaging upper edges of the sidewalls of the sink.

3 Claims, 4 Drawing Figures

HEAD SUPPORT

BACKGROUND OF THE INVENTION

The present invention relates in general to toiletries and deals more particularly with a head support for a sink which is used in a beauty parlor.

Beauty parlor sinks are normally configured to include a front wall which has a built-in U-shaped depression to support the neck of a subject while the subject's head is held above the sink bowl. During the shampooing and rinsing process, the subject's head is supported only by the neck in this depression in the front wall of the sink. This process can be very strenuous and uncomfortable for the subject. This is most notable when the subject is undergoing rinse during a permanent waving process and while the subject has the additional weight of perm rods in the hair.

Therefore, it is an object of this invention to provide a head supporting device which will effectively provide support to a subject's head to augment the neck support provided by the sink.

Another object of the invention is to provide a head support which is comfortable and is configured so as not to interfere with the process of rinsing the subject's hair.

A further object is to provide a head support which is lightweight, small and inexpensive.

Still another object is to provide a portable support which is compatible with standard beauty parlor sinks and can be quickly and easily installed and removed.

SUMMARY OF THE INVENTION

In accordance with the present invention a head support is provided for a sink which has a pair of sidewalls and a front wall connected to and extending between the sidewalls. The front wall has at least a portion of its upper edge disposed between the upper edges of the sidewalls. The head support comprises an elongated perforated flexible band of water resistant material which has apertures proximate its opposite ends. The band has a length substantially less than the width dimension of the sink as measured between the upper edges of the sidewalls. The head support further includes means for releasably attaching the band to the sink between the sidewalls and below the level of the upper edges of the sidewalls in suspended relation to the sink and includes a length of flexible cord which extends through the apertures and has a central portion which extends between the apertures and is disposed below and in adjacent relation to the band. The head support also includes means for releasably securing the opposite end portions of the cord to the upper edges of the sidewalls.

IN THE DRAWINGS

Figure 1:
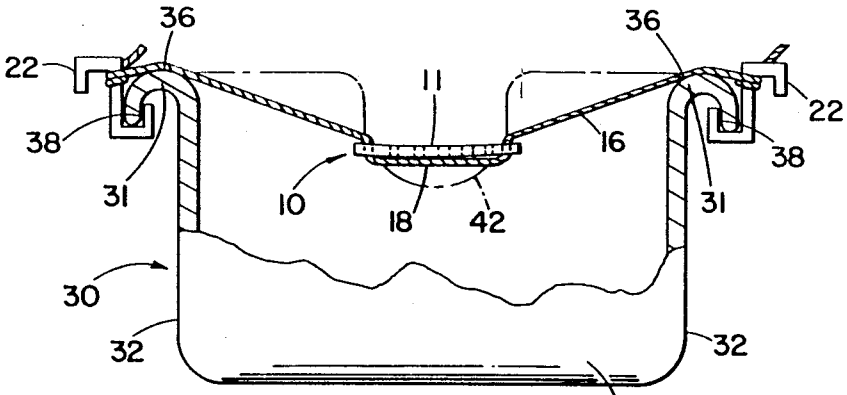
FIG. 1 is a front view of the head support embodying the present invention and shown attached to a sink in the manner in which it will be used, a portion of the front of the sink shown broken away.
Figure 2:
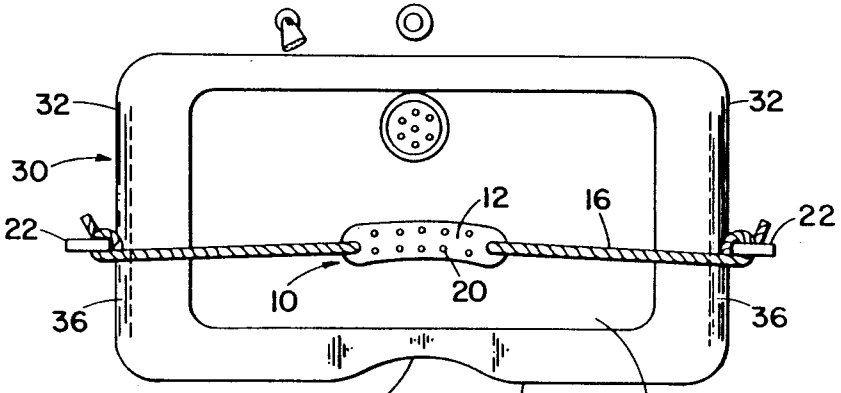
FIG. 2 is a top plan view of the head support as it appears in FIG. 1.

Referring to the drawings wherein like reference characters designate corresponding parts through the several Figures, a head support is shown generally at 10 in FIGS. 1 and 2 attached to a sink 30 in the manner in which it will be used. The head support preferably comprises a band 12 of flexible water resistant material which provides support directly to the back of a subject's head. The head support 10 also comprises a flexible cord 16 which is attached to the band 12 and also preferably includes hooks 22 which are tied or otherwise secured to the associated ends of the cord 16 and provide means for releasably attaching the head support 10 to the sink 30.

A beauty parlor sink 30 generally comprises a bottom wall 40, a pair of sidewalls 32 and a front wall 34 which is connected to and extending between the sidewalls. A portion of the upper edge 36 of the front wall 34 normally comprises a built-in U-shaped depression 42 for supporting the neck of a customer. The sidewalls 32 normally comprise downward and outward extending flanges 38.

In the preferred embodiment the head support is installed by engaging each hook 22 with the upper edge 36 of an associated sidewall to maintain the band 12 in suspended relation to the sink 30 and below the upper edges of said sidewalls and above the bottom wall 40, of the sink. The present invention provides support to the back of a subject's head which greatly augments the neck support which is normally provided by the U-shaped depression 42 in the beauty parlor sink 30.

Figure 3:
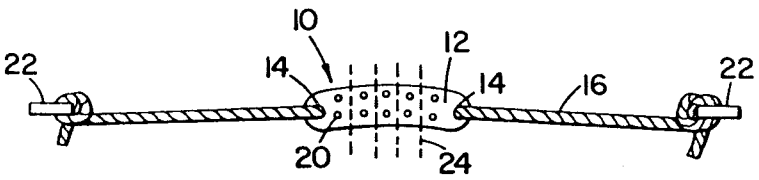
FIG. 3 is a top plan view of the head support and shows the primary axes of flexure of the band portion of the head support.
Figure 4:
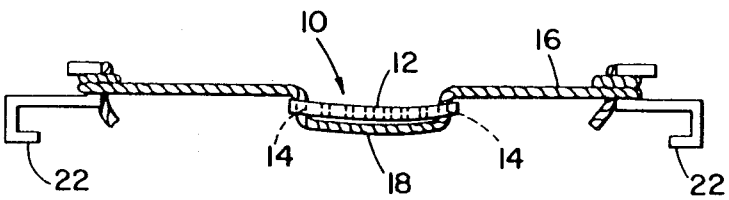
FIG. 4 is a side elevational view of the head support.

As shown in FIGS. 3 and 4, the flexible band portion 12 of the head support 10 is elongated and has a length substantially less than the width dimension of the sink 30 as measured between the upper edges 36 of the sidewalls 32. This band 12 preferably comprises a sheet of liquid impervious plastic material having substantially uniform thickness. The cord 16 and the hooks 22 also preferably comprise liquid impervious nylon or plastic material to insure that the head support 10 can be easily cleaned and sanitized.

The bank 12 has apertures 14 proximate its opposite ends to facilitate attachment of the flexible cord 16. The flexible cord 16 extends through these apertures 14 and has a central portion 18 which extends between the apertures 14 and is disposed below and in adjacent relation to the band 12.

The band 12 preferably has perforations 20 to facilitate the drainage of water. The cord 16 is preferably substantially thinner than the band 12. The perforated band 12 and the thin cord 16 allow for effective rinsing of the subject's hair and do not interfer with the drainage of water or splash of a directed stream of water.

The head support securing means preferably comprises a pair of hooks 22 secured to the opposite end portions of the flexible cord 16. These hooks 22 are preferably S-hooks which can be readily releasably attached to the flange portion 38 of the sink 30 as shown in FIG. 1. Inclusion of these hooks 22 in the design of the present invention results in a portable head support 10 which is compatible with standard beauty parlor sinks 30 and can be quickly and easily installed on and removed from an associated sink.

As shown in FIG. 3, the band 12 has primary axes of flexure 24 which extend transversely thereof. This in addition to the flexibility of the cord 16 results in a head support which conforms to the shape of a subject's head and is quite comfortable.

The present invention provides effective support for a subject's head while the subject is undergoing a hair rinsing process with the head suspended above a beauty parlor sink. The head support it portable, easy to use, easily cleaned, compatible with standard beauty sinks and can be inexpensively manufactured.

The invention which is intended to be protected herein is not to be construed to be limited to the particular forms disclosed, since they are to be regarded as illustrative rather as restrictive. Variations and changes may be made by those skilled in the art without departing from the spirit of the present invention.

What is claimed is:

1. A head support for use with a sink having a pair of opposing sidewalls and a front wall connected to and extending transversely between the sidewalls, the front wall having at least a portion of its upper edge disposed below the upper edges of the sidewalls, said head support consisting of an elongated flexible band of water impervious plastic material having a substantially uniform thickness and apertures proximate its opposite ends, said band having a length substantially greater than its width and substantially less than the transverse dimension of the sink as measured between the upper edges of the sink sidewalls, and means for releasably attaching said band to the sink between the sidewalls and below the level of the upper edges of the sidewalls in suspended relation to the sink and consisting of length of flexible cord extending upwardly through said apertures and having a central portion thereof extending between said apertures and disposed below and adjacent the lower surface said band and means for releasably securing the opposite end portions of said cord to the upper edges of the sidewalls and consisting of a pair of hooks, each of said hooks, being secured to an associated free end portion of said cord.

2. A head support for a sink as set forth in claim 1 wherein said band is perforated.

3. The combination comprising a sink and a head support releasably secured to said sink, said sink having a pair of transversely spaced apart sidewalls and a front wall integrally connected to and extending transversely between said sidewalls and having at least a portion of its upper edge disposed below the upper edges of said sidewalls, said head support consisting of a generally rectangular band of flexible water repellent material, said band having perforations therethrough and primary axes of flexure extending transversely of its longitudinal axis said band having a pair of apertures located generally on its central longitudinal axis, proximate its opposite ends, said band having a length substantially shorter than the width dimension of the sink as measured between the upper edges of the sidewalls, an elongated cord extending upwardly through said apertures and having a central portion extending between said apertures adjacent the lower surface of said band, and hooks tied to the opposite ends of said cord, each of said hooks releasably engaged with an upper edge of an associated sidewall and maintaining said band in suspended relation to the sink below the upper edges of said sidewalls and above the bottom surface of said sink.

* * * * *